US006779911B2

(12) United States Patent
Chang

(10) Patent No.: US 6,779,911 B2
(45) Date of Patent: Aug. 24, 2004

(54) SEPARATION DEVICE OF A LAMP HOLDER AND A FIXING SEAT

(75) Inventor: Chung-Min Chang, Taichung (TW)

(73) Assignee: Rhine Electronic Co., Ltd., Taichung (TW)

( * ) Notice: Subject to any disclaimer, the term of this patent is extended or adjusted under 35 U.S.C. 154(b) by 60 days.

(21) Appl. No.: 10/303,962

(22) Filed: Nov. 26, 2002

(65) Prior Publication Data

US 2004/0100802 A1 May 27, 2004

(51) Int. Cl.[7] ..... F21S 8/00

(52) U.S. Cl. ..... 362/430; 362/147; 362/226; 362/404; 362/427; 362/431; 439/220; 439/336

(58) Field of Search ..... 362/430, 147, 362/226, 404, 427, 431; 439/220, 336, 375, 419, 699.2

(56) References Cited

U.S. PATENT DOCUMENTS 1,710,532 A * 4/1929 De Karske ..... 248/343
5,634,820 A * 6/1997 Vakil ..... 439/646
5,658,074 A * 8/1997 Guritz ..... 362/396
6,682,303 B2 * 1/2004 Wu ..... 416/5
2002/0163812 A1 * 11/2002 Tseng ..... 362/404

* cited by examiner

*Primary Examiner*—Stephen Husar
*Assistant Examiner*—Sharon Payne
(74) *Attorney, Agent, or Firm*—Rosenberg, Klein & Lee

(57) ABSTRACT

A separation device of a lamp holder and a fixing seat includes a lamp holder, a lamp connecting seat, an electrode, a fixing seat, a cover plate, a fixing bracket, and two safety locking members. When the lamp holder registers the fixing seat, the lamp holder is rotated relative to the fixing seat, so that the lamp holder is integrally combined with the fixing seat. Thus, the separation device is assembled and disassembled easily and conveniently. In addition, the lamp can be inserted into the lamp connecting seat only when each of the two safety locking members is exactly locked on the lamp holder and the fixing seat, thereby forming a safety locking effect.

17 Claims, 8 Drawing Sheets

SEPARATION DEVICE OF A LAMP HOLDER AND A FIXING SEAT

BACKGROUND OF THE INVENTION

1. Field of the Invention

The present invention relates to a separation device of a lamp holder and a fixing seat, and more particularly to a separation device that is assembled and disassembled rapidly, easily and conveniently, thereby facilitating replacement and maintenance of the separation device.

2. Description of the Related Art

A conventional lamp in accordance with the prior art comprises a shade seat, a shade mounted on the bottom of the shade seat, a fixing device mounted in the shade seat, a lamp rack mounted on the shade seat and having a distal end connected to the fixing device, and a lamp body mounted in the shade and connected to the fixing device. The fixing device contains an electronic ballast therein. The fixing device is connected with an electric wire which is connected to a junction box of the ceiling fan through the lamp rack.

However, the conventional lamp having an electronic stabilizer in accordance with the prior art has the following disadvantages.

1. The electronic ballast mounted in the fixing device that is hidden in the shade is easily worn out. Thus, when the electronic ballast is worn out, the user has to detach the lamp body, then detach the shade from the shade seat, thereby exposing the fixing device, and then detach and replace the entire fixing device. Then, the user has to mount a new fixing device in the shade seat, then mount the shade in the shade seat, and then mount the lamp body. Thus, it takes a long time and much manual work to replace the fixing device, thereby greatly increasing inconvenience and difficulty in maintenance of the fixing device.

2. The fixing device is connected to the electric wire. Thus, when the electronic ballast in the fixing device is worn out, the user has to detach the shade seat and the shade, and to detach the fixing device from the electric wire for replacing the fixing device and the electronic stabilizer in the fixing device, thereby easily causing danger in maintenance of the fixing device.

3. The user has to replace the entire fixing device when the electronic ballast or other parts contained in the fixing device is worn out, thereby causing improper consumption of material and increasing the cost, and thereby easily causing an environmental pollution.

SUMMARY OF THE INVENTION

The present invention has arisen to mitigate and/or obviate the disadvantage of the conventional lamp.

The primary objective of the present invention is to provide a separation device of a lamp holder and a fixing seat, wherein when the lamp holder registers the fixing seat, the lamp holder is rotated relative to the fixing seat, so that the lamp holder is integrally combined with the fixing seat. Thus, the separation device is assembled and disassembled easily and conveniently.

Another objective of the present invention is to provide a separation device of a lamp holder and a fixing seat, wherein each of the two safety locking members is exactly locked on the lamp holder and the fixing seat when the lamp holder is aligned with the fixing seat, so that the separation device is assembled and disassembled easily and conveniently.

A further objective of the present invention is to provide a separation device of a lamp holder and a fixing seat, wherein the main parts are mounted in the lamp holder, so that they can be detached and replaced rapidly, easily and conveniently, thereby facilitating replacement and maintenance of the separation device of the present invention.

A further objective of the present invention is to provide a separation device of a lamp holder and a fixing seat, wherein the lamp holder and the fixing seat are assembled and disassembled easily and conveniently, thereby facilitating replacement and maintenance of the separation device of the present invention.

A further objective of the present invention is to provide a separation device of a lamp holder and a fixing seat, wherein the lamp can be inserted into the lamp connecting seat only when each of the two safety locking members is exactly locked on the lamp holder and the fixing seat, thereby forming a double safety locking effect.

In accordance with the present invention, there is provided a separation device of a lamp holder and a fixing seat, comprising a lamp holder, a lamp connecting seat, an electrode, a fixing seat, and two safety locking members, wherein:

the lamp holder has a closed end provided with a protruding guide column which has a periphery formed with two radially opposite locking portions and an orientation portion;

the lamp connecting seat is mounted in the lamp holder;

the electrode is mounted in the lamp holder;

the fixing seat has a first end fixed on the closed end of the lamp holder, the first end of the fixing seat has a center formed with a guide hole for receiving the guide column of the lamp holder, the guide hole of the fixing seat has a wall formed with two radially opposite recessed guide portions for guiding a respective one of the two locking portions of the lamp holder, and formed with two radially opposite retaining rails each located beside a respective one of the two guide portions for retaining a respective one of the two locking portions of the lamp holder, the wall of the guide hole of the fixing seat is formed with an arcuate orientation slot for receiving the orientation portion of the lamp holder; and each of the two safety locking members is mounted between the lamp holder and the fixing seat, so that the lamp holder and the fixing seat are locked with each other, thereby integrally combining the lamp holder with the fixing seat.

Further benefits and advantages of the present invention will become apparent after a careful reading of the detailed description with appropriate reference to the accompanying drawings.

DETAILED DESCRIPTION OF THE INVENTION

Figure 1:
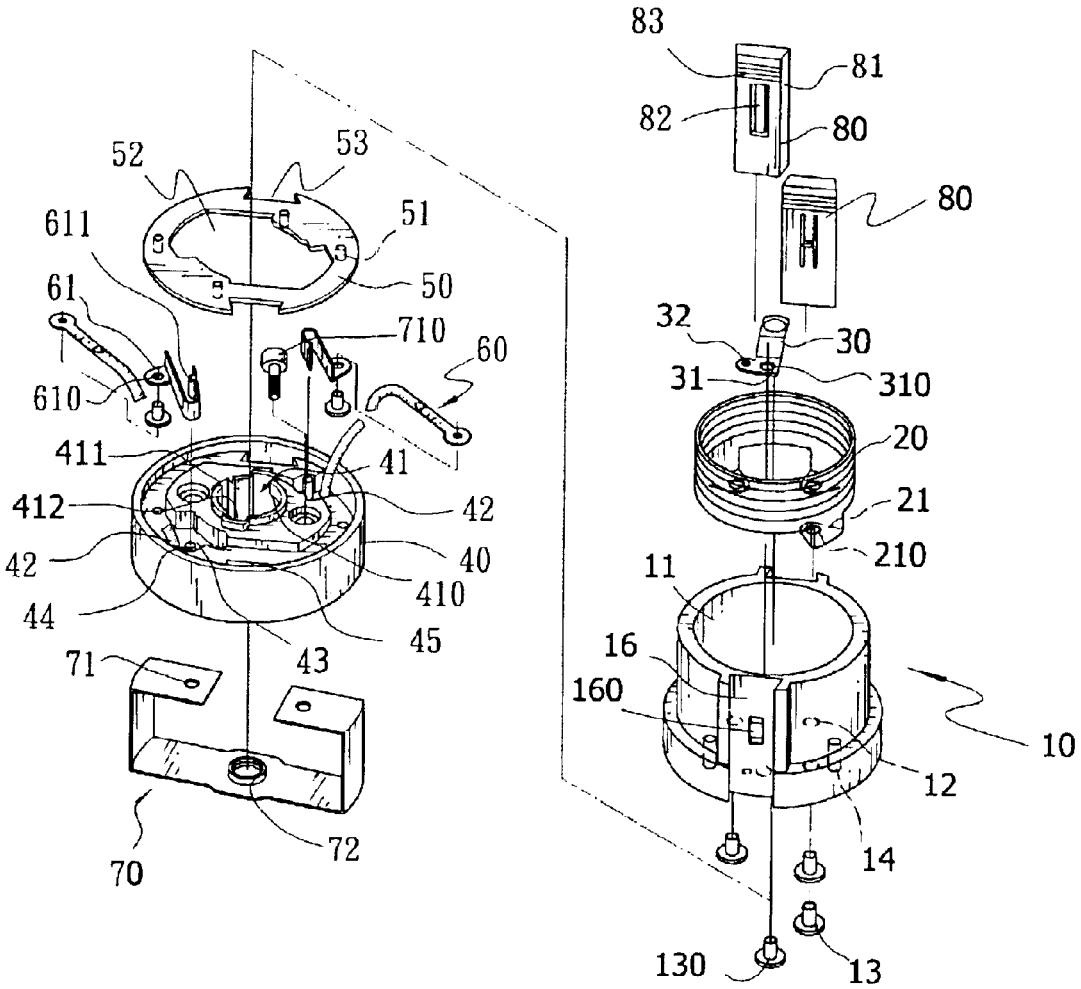
FIG. 1 is an exploded perspective view of a separation device in accordance with a preferred embodiment of the present invention.
Figure 2:
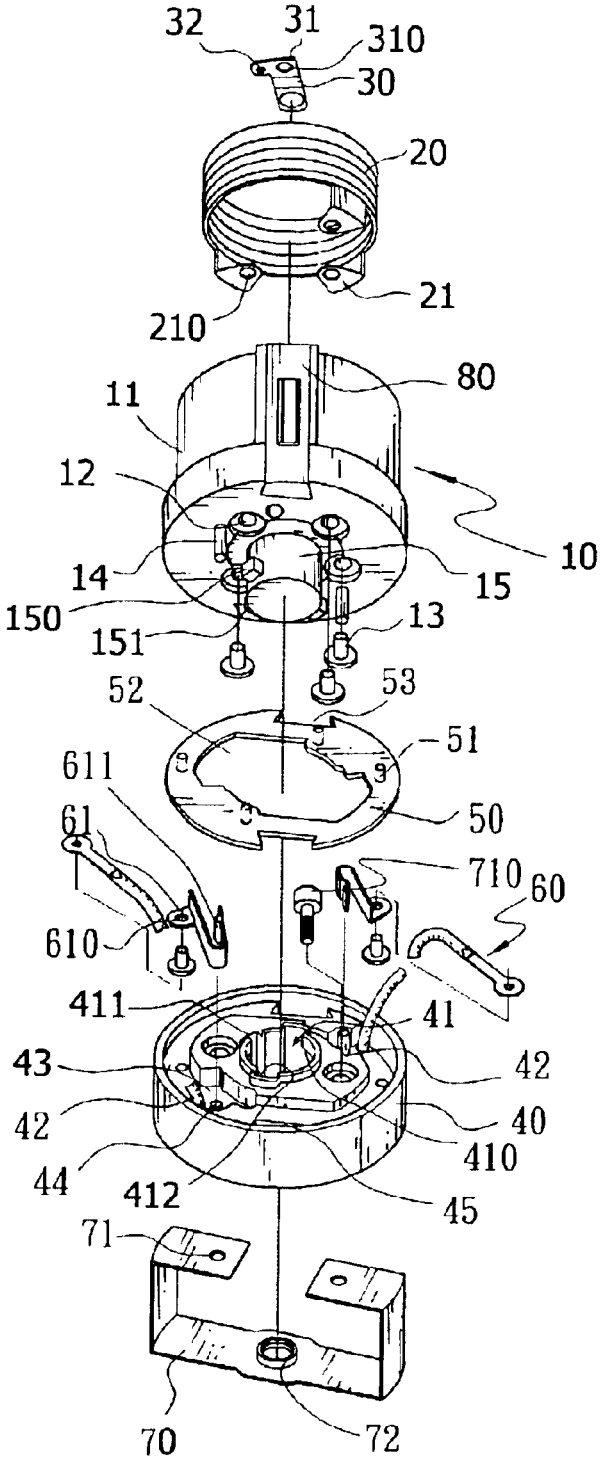
FIG. 2 is an exploded perspective view of the separation device in accordance with the preferred embodiment of the present invention.
Figure 3:
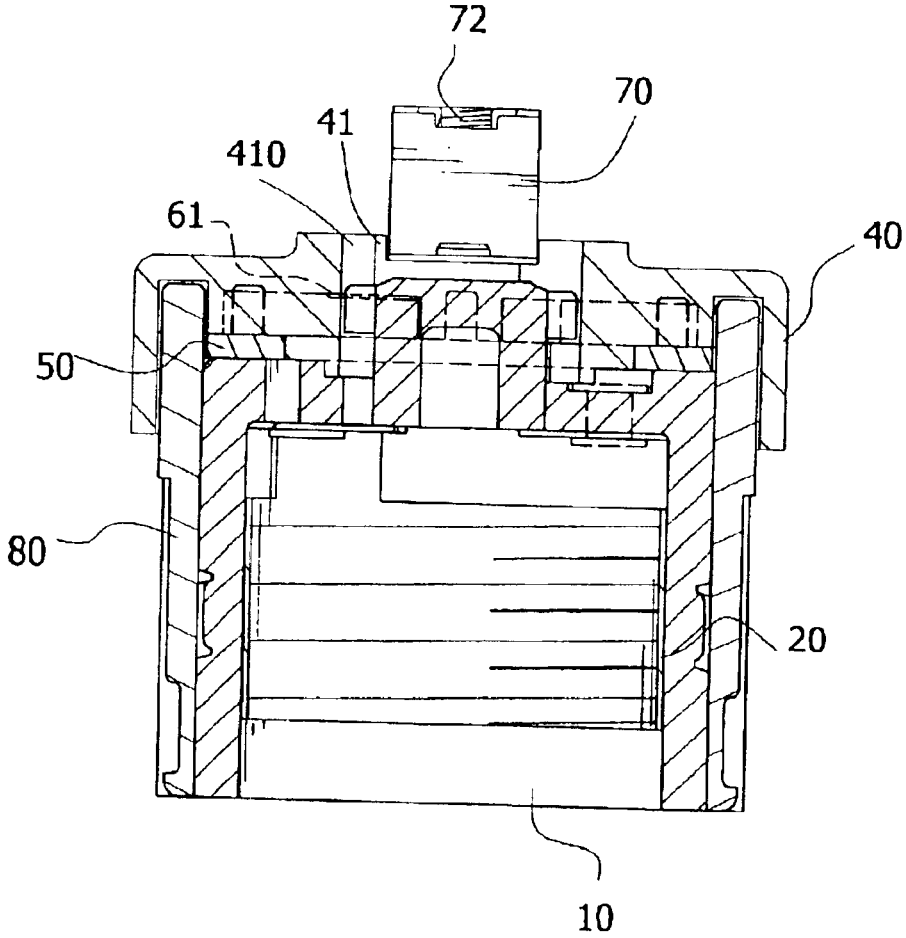
FIG. 3 is a plan cross-sectional assembly view of the separation device as shown in FIG. 1.
Figure 4:
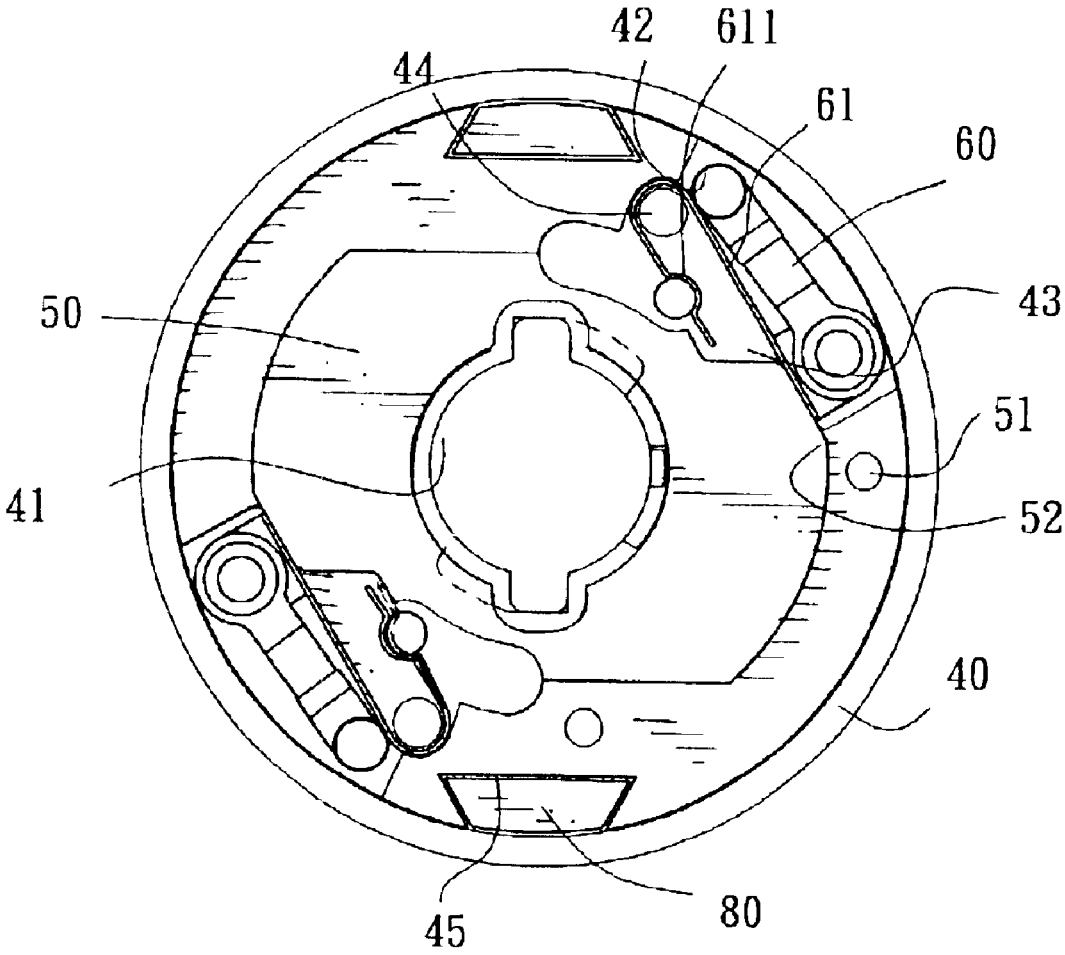
FIG. 4 is a top plan cross-sectional assembly view of the separation device as shown in FIG. 1.
Figure 5:
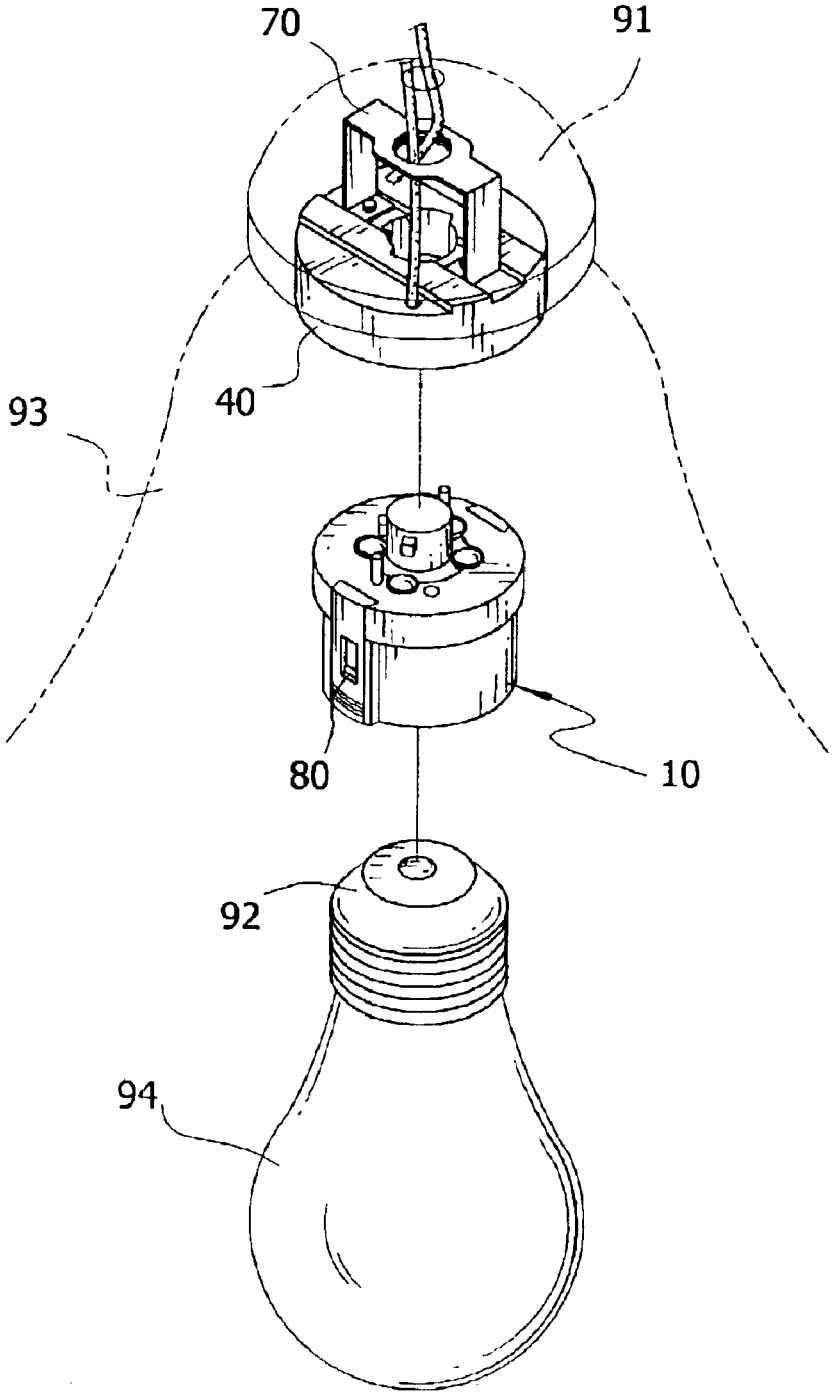
FIG. 5 is a partially perspective assembly view of the separation device in accordance with the preferred embodiment of the present invention.
Figure 6:
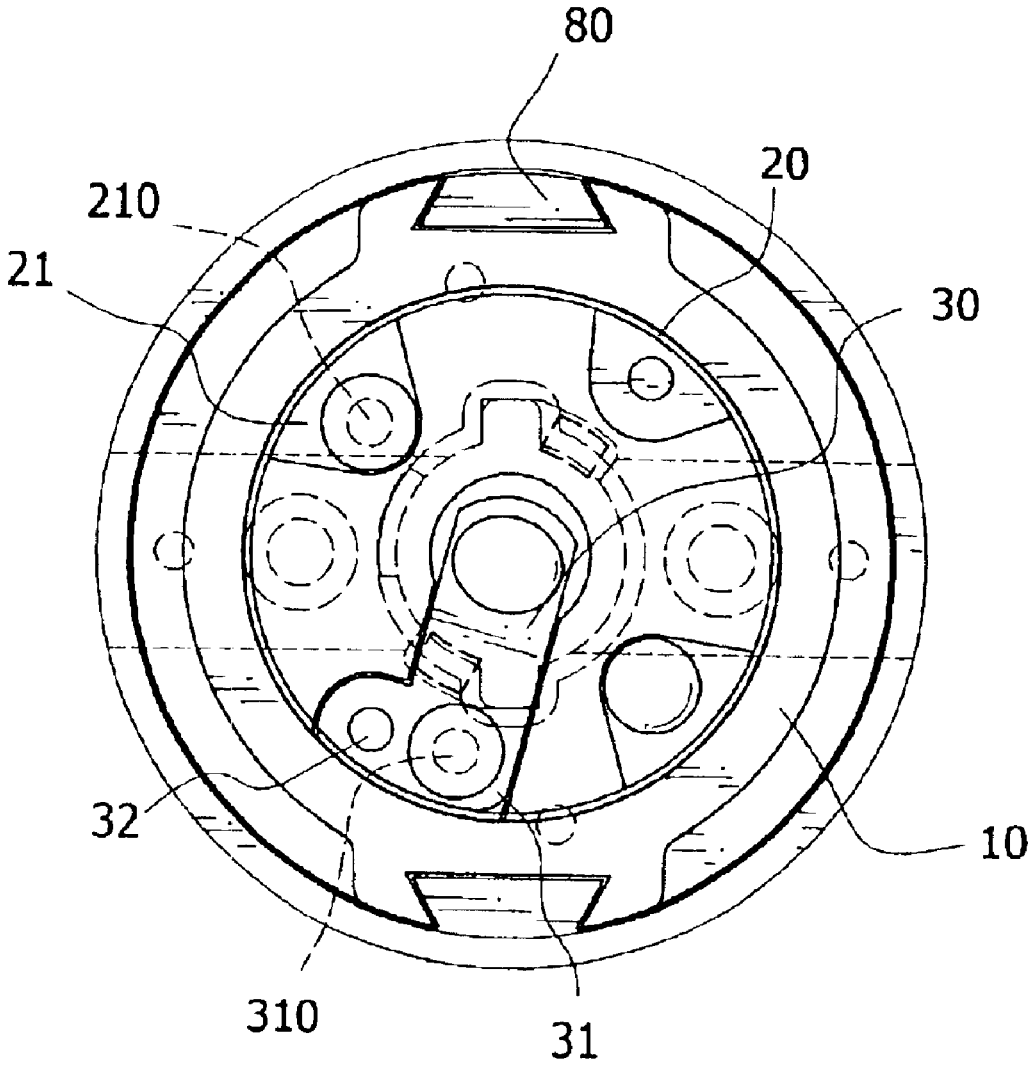
FIG. 6 is a another top plan cross-sectional assembly view of the separation device as shown in FIG. 1.
Figure 7:
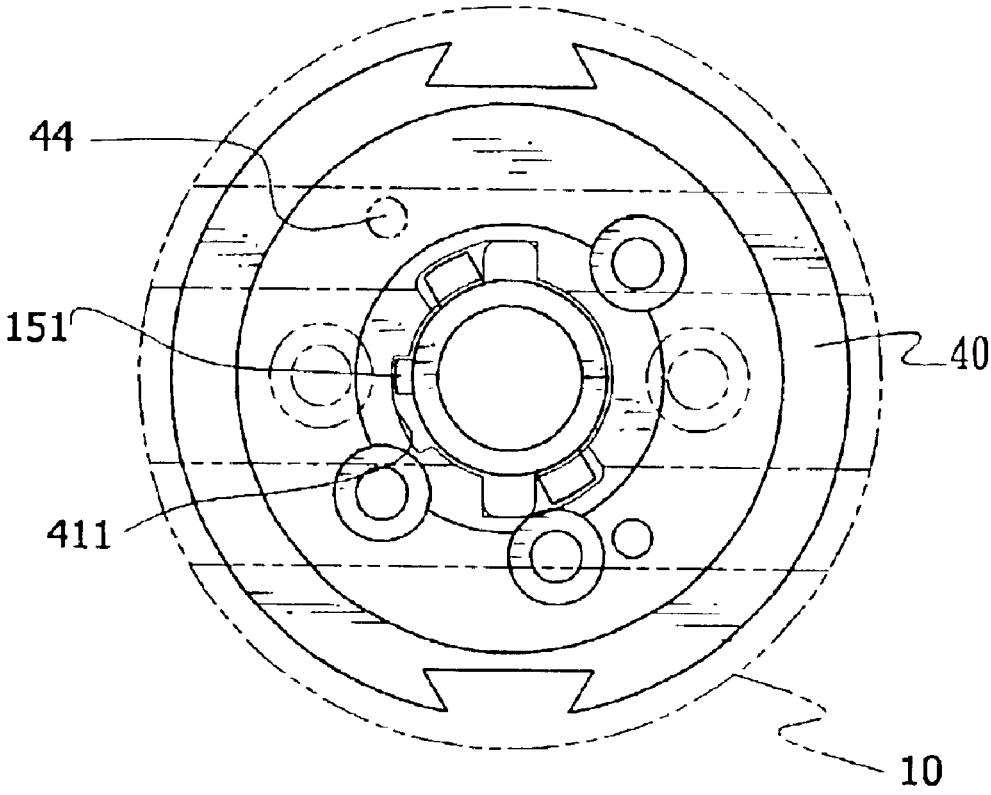
FIG. 7 is a another top plan cross-sectional assembly view of the separation device as shown in FIG. 1.

Referring to the drawings and initially to FIGS. 1–7, a separation device of a lamp holder and a fixing seat in accordance with a preferred embodiment of the present invention mounted on a lamp as shown in FIG. 5.

As shown in FIG. 5, the lamp includes a shade seat 91, a shade 93 mounted on the bottom of the shade seat 91, and a bulb 94 having a bulb seat 92. The separation device in accordance with the present invention is mounted between the bulb 94 and the shade seat 91, and can be detached and replaced.

Referring to FIGS. 1–5, the separation device in accordance with the preferred embodiment of the present invention comprises a lamp holder 10, a lamp connecting seat 20, an electrode 30, a fixing seat 40, a cover plate 50, a fixing bracket 70, and two safety locking members 80.

The lamp holder 10 has an inner wall formed with a receiving chamber 11 for receiving the lamp connecting seat 20 and the electrode 30. The receiving chamber 11 of the lamp holder 10 has closed end formed with four fixing holes 12. The closed end of the receiving chamber 11 of the lamp holder 10 is provided with two protruding metallic conductive members 14 each connected to one of two V-shaped elastic conductive plates 61 mounted in the fixing seat 40.

The lamp connecting seat 20 is received in the receiving chamber 11 of the lamp holder 10, and is provided with three connecting legs 21 each formed with a fixing hole 210. The lamp holder 10 includes three first fixing members 13 each extended through a respective one of three of the four fixing holes 12 of the lamp holder 10 and each riveted in the fixing hole 210 of a respective one of the three connecting legs 21 of the lamp connecting seat 20, thereby fixing the lamp connecting seat 20 on the lamp holder 10. The three connecting legs 21 of the lamp connecting seat 20 are electrically connected to one of the two conductive members 14 of the lamp holder 10.

The electrode 30 is received in the receiving chamber 11 of the lamp holder 10, and has a connecting leg 31 formed with a fixing hole 310. The lamp holder 10 includes a second fixing member 130 extended through the other one of the four fixing holes 12 of the lamp holder 10 and riveted in the fixing hole 310 of the connecting leg 31 of the electrode 30, thereby fixing the electrode 30 on the lamp holder 10. The connecting leg 31 of the electrode 30 has a protruding conductive portion 32 electrically connected to the other one of the two conductive members 14 of the lamp holder 10.

The fixing seat 40 has a first end fixed on the closed end of the lamp holder 10. The closed end of the lamp holder 10 is provided with a protruding guide column 15 which has a periphery formed with two radially opposite locking portions 150 and an orientation portion 151. The first end of the fixing seat 40 has a center formed with a guide hole 41 for receiving the guide column 15 of the lamp holder 10. The guide hole 41 of the fixing seat 40 has a wall formed with two radially opposite recessed guide portions 412 for guiding a respective one of the two locking portions 150 of the lamp holder 10, and formed with two radially opposite retaining rails 410 each located beside a respective one of the two guide portions 412 for retaining a respective one of the two locking portions 150 of the lamp holder 10. The wall of the guide hole 41 of the fixing seat 40 is formed with an arcuate orientation slot 411 (see FIG. 7) for receiving the orientation portion 151 of the lamp holder 10.

In assembly, when the guide column 15 of the lamp holder 10 is inserted into the guide hole 41 of the fixing seat 40, the lamp holder 10 is rotated relative to the fixing seat 40 until the orientation portion 151 of the lamp holder 10 aligns with the orientation slot 411 of the fixing seat 40 and each of the two locking portions 150 of the lamp holder 10 aligns with the respective guide portion 412 of the fixing seat 40, so that each of the two locking portions 150 of the lamp holder 10 is inserted into the respective guide portion 412 of the fixing seat 40. Then, the lamp holder 10 is rotated relative to the fixing seat 40, so that each of the two locking portions 150 of the lamp holder 10 is rested on and retained by the respective retaining rail 410 of the fixing seat 40. Thus, the lamp holder 10 is integrally combined with the fixing seat 40.

The first end of the fixing seat 40 has a periphery formed with two opposite passage holes 42 for passage of two electric wires 60, and formed with two opposite receiving recesses 43 (see FIG. 4) each located beside a respective one of the two opposite passage holes 42. Each of the two opposite receiving recesses 43 is provided with a limit post 44. Each of the two V-shaped elastic conductive plates 61 is mounted on the limit post 44 of a respective one of the two opposite receiving recesses 43 of the fixing seat 40.

Each of the two elastic conductive plates 61 has a first end provided with a ring-shaped connecting portion 610 connected to a respective one of the two electric wires 60, and a second end provided with an elastic locking portion 611 connected to a respective one of the two metallic conductive members 14 of the lamp holder 10.

The cover plate 50 is mounted on the first end of the fixing seat 40, thereby preventing the elastic conductive plates 61 from being exposed outward. The cover plate 50 is formed with a passage slot 52 for passage of the guide column 15 of the lamp holder 10. The cover plate 50 has a periphery provided with a plurality of protruding positioning portions 51 secured on the fixing seat 40, so that the cover plate 50 is integrally combined with the fixing seat 40.

The fixing bracket 70 is substantially U-shaped, and is secured on a second end of the fixing seat 40. The fixing bracket 70 has two bent ends each formed with a screw bore 71, so that each of two fixing bolts 710 is in turn extended through the fixing seat 40 and is screwed into the screw bore 71 of the fixing bracket 70, thereby fixing the fixing bracket 70 on the fixing seat 40. The fixing bracket 70 has a center formed with a threaded passage hole 72 for passage of the electric wires 60. The fixing bracket 70 can be combined with other part by the threaded passage hole 72.

Each of the two safety locking members 80 is mounted between the lamp holder 10 and the fixing seat 40, so that the lamp holder 10 and the fixing seat 40 are locked with each other, thereby integrally combining the lamp holder 10 with the fixing seat 40.

The lamp holder 10 has an outer wall formed with two radially opposite dovetail-shaped guide locking channels 16. The cover plate 50 has an outer wall formed with two radially opposite dovetail-shaped guide locking grooves 53. The fixing seat 40 has a periphery formed with two radially opposite dovetail-shaped recessed guide locking portions 45. Each of the two safety locking members 80 has a dovetail-shaped cross-section, and is locked in a respective one of the two dovetail-shaped guide locking channels 16 of the lamp holder 10, a respective one of the two dovetail-shaped guide locking grooves 53 of the cover plate 50, and a respective one of the two dovetail-shaped guide locking portions 45 of the fixing seat 40. Each of the two safety locking members 80 has two sides each formed with an oblique locking portion 81.

Each of the two guide locking channels 16 of the lamp support body 10 has a wall formed with a limit slot 160. Each of the two safety locking members 80 is provided with an elastic limit portion 82 that is elastically locked in the limit slot 160 of a respective one of the two guide locking channels 16 of the lamp holder 10, so that each of the two safety locking members 80 is locked in a respective one of the two guide locking channels 16 of the lamp holder 10. Each of the two safety locking members 80 has a surface provided with a serrated push portion 83, thereby facilitating movement of each of the two safety locking members 80.

In assembly, when each of the two guide locking channels 16 of the lamp holder 10 is aligned with the respective guide locking portion 45 of the fixing seat 40, each of the two safety locking members 80 is moved in the respective guide locking channel 16 of the lamp holder 10 until the elastic limit portion 82 of each of the two safety locking members 80 is locked in the limit slot 160 of the respective guide locking channel 16 of the lamp holder 10, so that each of the two safety locking members 80 is locked in the respective guide locking channel 16 of the lamp holder 10, and is locked in the respective guide locking portion 45 of the fixing seat 40.

In such a manner, each of the two safety locking members 80 is fully hidden into the respective guide locking channel 16 of the lamp holder 10 and the respective guide locking portion 45 of the fixing seat 40, so that each of the two safety locking members 80 will not protrude from the lamp connecting seat 20. Thus, the bulb seat 92 of the bulb 94 is inserted into the lamp connecting seat 20 for use. If either one of the two safety locking members 80 is not exactly inserted into the respective guide locking portion 45 of the fixing seat 40, the either one of the two safety locking members 80 will protrude outward from the lamp connecting seat 20 and the lamp holder 10, so that the bulb seat 92 of the bulb 94 cannot be inserted into the lamp connecting seat 20, thereby forming a double safety locking effect.

Figure 8:
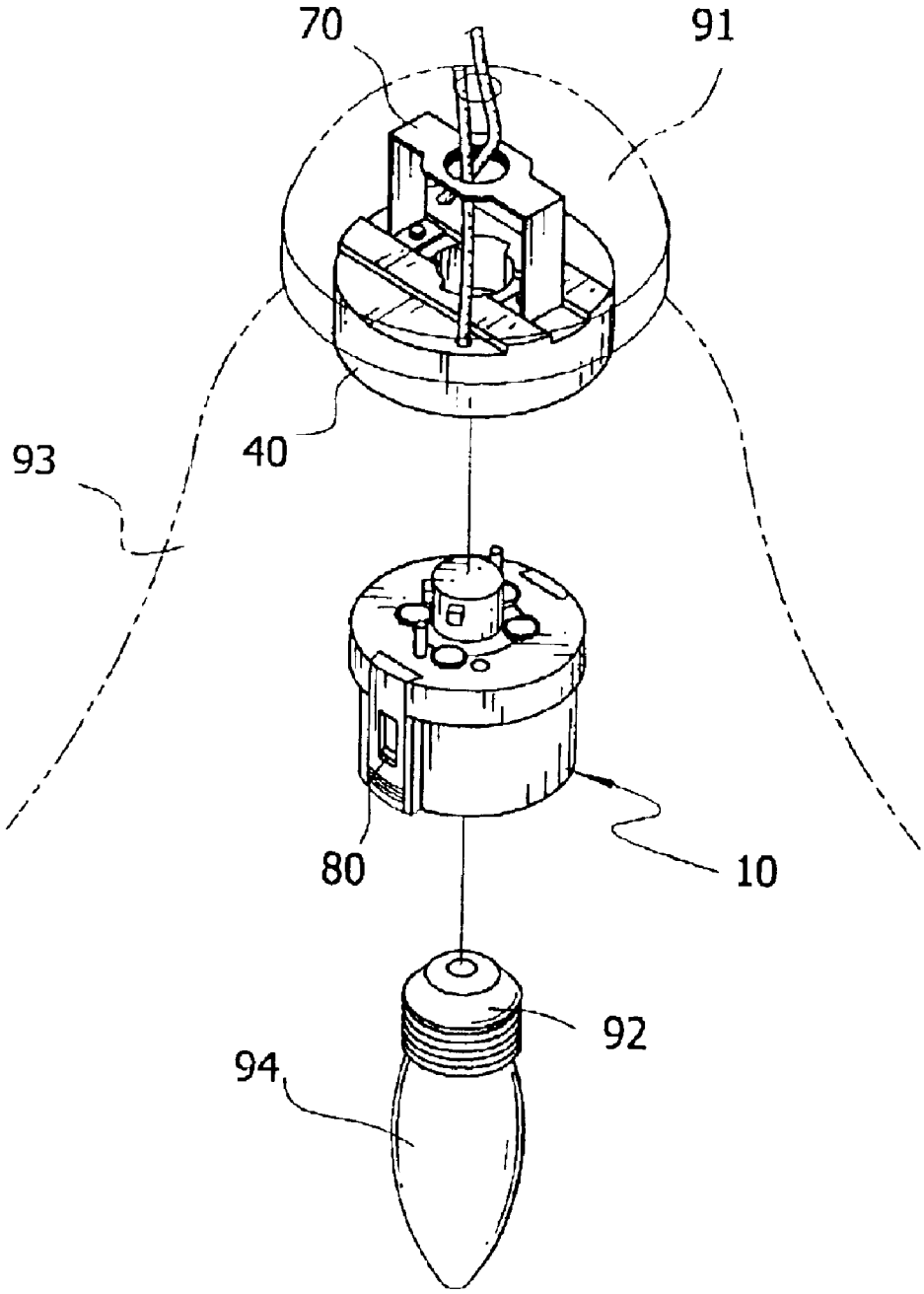
FIG. 8 is a partially perspective assembly view of the separation device in accordance with another preferred embodiment of the present invention.

Referring to FIG. 8, the lamp connecting seat 20 has a different size to fit the bulb seat 92 of the bulb 94 with a different size, thereby enhancing the versatility of the separation device in accordance with the present invention is shown.

Accordingly, the separation device in accordance with the present invention has the following advantages.

1. When the lamp holder 10 registers the fixing seat 40, the lamp holder 10 is rotated relative to the fixing seat 40, so that the lamp holder 10 is integrally combined with the fixing seat 40. Thus, the separation device of the present invention is assembled and disassembled easily and conveniently.

2. Each of the two safety locking members 80 is exactly locked on the lamp holder 10 and the fixing seat 40 when the lamp holder 10 is aligned with the fixing seat 40, so that the separation device of the present invention is assembled and disassembled easily and conveniently.

3. The main parts (such as the lamp connecting seat 20 and the electrode 30) are mounted in the lamp holder 10, so that they can be detached and replaced rapidly, easily and conveniently, thereby facilitating replacement and maintenance of the separation device of the present invention.

4. The lamp holder 10 and the fixing seat 40 are assembled and disassembled easily and conveniently, thereby facilitating replacement and maintenance of the separation device of the present invention.

5. The lamp can be inserted into the lamp connecting seat 20 only when each of the two safety locking members 80 is exactly locked on the lamp holder 10 and the fixing seat 40, thereby forming a double safety locking effect.

While the preferred embodiment(s) of the present invention has been shown and described, it will be apparent to those skilled in the art that various modifications may be made in the embodiment(s) without departing from the spirit of the present invention. Such modifications are all within the scope of the present invention.

What is claimed is:

1. A separation device of a lamp holder and a fixing seat, comprising a lamp holder, a lamp connecting seat, an electrode, a fixing seat, and two safety locking members, wherein:

the lamp holder has a closed end provided with a protruding guide column which has a periphery formed with two radially opposite locking portions and an orientation portion;

the lamp connecting seat is mounted in the lamp holder;

the electrode is mounted in the lamp holder;

the fixing seat has a first end fixed on the closed end of the lamp holder, the first end of the fixing seat has a center formed with a guide hole for receiving the guide column of the lamp holder, the guide hole of the fixing seat has a wall formed with two radially opposite recessed guide portions for guiding a respective one of the two locking portions of the lamp holder, and formed with two radially opposite retaining rails each located beside a respective one of the two guide portions for retaining a respective one of the two locking portions of the lamp holder, the wall of the guide hole of the fixing seat is formed with an arcuate orientation slot for receiving the orientation portion of the lamp holder; and each of the two safety locking members is mounted between the lamp holder and the fixing seat, so that the lamp holder and the fixing seat are locked with each other, thereby integrally combining the lamp holder with the fixing seat.

2. The separation device of a lamp holder and a fixing seat in accordance with claim 1, wherein the lamp holder has an inner wall formed with a receiving chamber for receiving the lamp connecting seat and the electrode.

3. The separation device of a lamp holder and a fixing seat in accordance with claim 1, wherein the closed end of the lamp holder is formed with four fixing holes, the lamp connecting seat is provided with three connecting legs each formed with a second fixing hole, and the lamp holder includes three first fixing members each extended through a respective one of three of the four fixing holes of the lamp holder and each riveted in the second fixing hole of a respective one of the three connecting legs of the lamp connecting seat, thereby fixing the lamp connecting seat on the lamp holder.

4. The separation device of a lamp holder and a fixing seat in accordance with claim 3, wherein the electrode has a connecting leg formed with a third fixing hole, and the lamp holder includes a second fixing member extended through the other one of the four fixing holes of the lamp holder and riveted in the third fixing hole of the connecting leg of the electrode, thereby fixing the electrode on the lamp holder.

5. The separation device of a lamp holder and a fixing seat in accordance with claim 4, wherein the closed end of the lamp holder is provided with two protruding metallic conductive members each connected to one of two V-shaped elastic conductive plates mounted in the fixing seat, the three connecting legs of the lamp connecting seat are electrically connected to one of the two conductive members of the lamp holder, and the connecting leg of the electrode has a protruding conductive portion electrically connected to the other one of the two conductive members of the lamp holder.

6. The separation device of a lamp holder and a fixing seat in accordance with claim 5, wherein the first end of the fixing seat has a periphery formed with two opposite passage holes for passage of two electric wires, and formed with two opposite receiving recesses, each of the two opposite receiving recesses is provided with a limit post, each of the two elastic conductive plates is mounted on the limit post of a respective one of the two opposite receiving recesses of the fixing seat, each of the two elastic conductive plates has a first end provided with a ring-shaped connecting portion connected to a respective one of the two electric wires, and a second end provided with an elastic locking portion connected to a respective one of the two metallic conductive members of the lamp holder.

7. The separation device of a lamp holder and a fixing seat in accordance with claim 1, further comprising a cover plate mounted on the first end of the fixing seat, thereby preventing the elastic conductive plates from being exposed outward.

8. The separation device of a lamp holder and a fixing seat in accordance with claim 7, wherein the cover plate is formed with a passage slot for passage of the guide column of the lamp holder.

9. The separation device of a lamp holder and a fixing seat in accordance with claim 7, wherein the cover plate has a periphery provided with a plurality of protruding positioning portions secured on the fixing seat, so that the cover plate is integrally combined with the fixing seat.

10. The separation device of a lamp holder and a fixing seat in accordance with claim 1, further comprising a fixing bracket secured on a second end of the fixing seat.

11. The separation device of a lamp holder and a fixing seat in accordance with claim 10, wherein the fixing bracket has two bent ends each formed with a screw bore, so that each of two fixing bolts is in turn extended through the fixing seat and is screwed into the screw bore of the fixing bracket, thereby fixing the fixing bracket on the fixing seat.

12. The separation device of a lamp holder and a fixing seat in accordance with claim 10, wherein the fixing bracket has a center formed with a threaded passage hole for passage of the electric wires.

13. The separation device of a lamp holder and a fixing seat in accordance with claim 1, wherein the lamp holder has an outer wall formed with two radially opposite dovetail-shaped guide locking channels, the fixing seat has a periphery formed with two radially opposite dovetail-shaped recessed guide locking portions, and each of the two safety locking members has a dovetail-shaped cross-section and is locked in a respective one of the two dovetail-shaped guide locking channels of the lamp holder, and a respective one of the two dovetail-shaped guide locking portions of the fixing seat.

14. The separation device of a lamp holder and a fixing seat in accordance with claim 13, wherein each of the two safety locking members has two sides each formed with an oblique locking portion.

15. The separation device of a lamp holder and a fixing seat in accordance with claim 13, wherein each of the two guide locking channels of the lamp holder has a second wall formed with a limit slot, and each of the two safety locking members is provided with an elastic limit portion that is elastically locked in the limit slot of a respective one of the two guide locking channels of the lamp holder, so that each of the two safety locking members is locked in a respective one of the two guide locking channels of the lamp holder.

16. The separation device of a lamp holder and a fixing seat in accordance with claim 1, wherein each of the two safety locking members has a surface provided with a serrated push portion.

17. The separation device of a lamp holder and a fixing seat in accordance with claim 1, wherein further comprising a cover plate mounted on the first end of the fixing seat, wherein the cover plate has an outer wall formed with two radially opposite dovetail-shaped guide locking grooves, and each of the two safety locking members has a dovetail-shaped cross-section and is locked in a respective one of the two dovetail-shaped guide locking grooves of the cover plate.

* * * * *